US011071357B2

(12) United States Patent
Miwa

(10) Patent No.: US 11,071,357 B2
(45) Date of Patent: Jul. 27, 2021

(54) SLIDE FASTENER AND METHOD FOR MANUFACTURING SAME

(71) Applicant: YKK Corporation, Tokyo (JP)

(72) Inventor: Yasushi Miwa, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/478,970

(22) PCT Filed: Feb. 2, 2017

(86) PCT No.: PCT/JP2017/003865
§ 371 (c)(1),
(2) Date: Jul. 18, 2019

(87) PCT Pub. No.: WO2018/142553
PCT Pub. Date: Aug. 9, 2018

(65) Prior Publication Data

US 2019/0365059 A1 Dec. 5, 2019

(51) Int. Cl.
*A44B 19/38* (2006.01)
*A44B 19/60* (2006.01)

(52) U.S. Cl.
CPC ..... *A44B 19/38* (2013.01); *A44B 19/60* (2013.01)

(58) Field of Classification Search
CPC ..... A44B 19/38; A44B 19/60
See application file for complete search history.

(56) References Cited

U.S. PATENT DOCUMENTS 4,312,103 A 1/1982 Akashi
6,851,162 B2 * 2/2005 Yuki ..... A44B 19/38 24/433
9,295,307 B2 * 3/2016 Tominaga ..... A44B 19/08
2002/0129470 A1 9/2002 Kiely
2003/0020201 A1 1/2003 Cao
2003/0140465 A1 7/2003 Yuki et al.

FOREIGN PATENT DOCUMENTS

EP 1330967 A1 1/2003
JP 2003-052419 A 2/2003
JP 3733332 B2 1/2006
WO 2012/090276 A1 7/2012
WO 2014/192106 A1 12/2014

OTHER PUBLICATIONS

International Search Report, PCT Application No. PCT/JP2017/003865, dated Apr. 18, 2017.
Office Action, Chinese Patent Application No. 201780082047.9, dated Apr. 21, 2021, 15 pages.

* cited by examiner

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A slide fastener includes: a pair of fastener stringers each provided with a fastener element at a bent side-edge portion of a fastener tape; a slider that moves for opening or closing the pair of fastener stringers; and a pair of resin-made terminal members each fixed to the fastener tape adjacently to the fastener element in a terminal portion of the fastener tape in an elongation direction of the fastener tape, the pair of terminal members including a pin and a socket configured to receive the pin. Reinforcing films are attached to both tape surfaces of at least one fastener tape in the terminal portion, and each reinforcing film has an embedded portion embedded in the terminal member.

18 Claims, 13 Drawing Sheets

SLIDE FASTENER AND METHOD FOR MANUFACTURING SAME

TECHNICAL FIELD

The present disclosure is related to a slide fastener and a method of producing the same.

BACKGROUND ART

Patent literature 1 discloses pin and socket to which reinforcing portions 34, 35 are integrally molded.

Patent literature 2 discloses that metal pin and socket are attached through swaging to a fastener tape to which a reinforcing tape is attached.

CITATION LIST

Patent Literature

Patent literature 1 International Publication No. 2014/192106

Patent literature 2 Japanese Patent No. 3733332

SUMMARY

Technical Problem

In the patent literature 1, the fastener tape is protected by the reinforcing portions 34, 35 that are resin portions of the pin and socket. In such a case, the reinforcing portions 34, 35 may be partially damaged, the flexibility of fastener tape may be lowered, and attachment of a slide fastener to an article such as clothing or the like may be disturbed in greater or lesser degree.

As would be understood from the above-described non-limiting exemplary technical challenge, it is desired to avoid or mitigate one or more disadvantages due to the employment of the reinforcing portion of the pin or the socket.

Solution to Problem

Slide fastener according to an aspect of the present disclosure may include:

a pair of fastener stringers each provided with a fastener element at a bent side-edge portion of a fastener tape;

a slider that moves for opening or closing the pair of fastener stringers; and a pair of resin-made terminal members each fixed to the fastener tape adjacently to the fastener element in a terminal portion of the fastener tape in an elongation direction of the fastener tape, the pair of terminal members including a pin and a socket configured to receive the pin, wherein reinforcing films are attached to both tape surfaces of at least one fastener tape in the terminal portion, each reinforcing film having an embedded portion embedded in the terminal member.

In some embodiments, the terminal member includes a bar and a flange, and a groove is provided between the bar and the flange.

In some embodiments, at least one of the reinforcing films has an end that is embedded in the flange.

In some embodiments, at least one of the terminal members includes a filled portion that is filled in a through-hole provided in a tape main portion of the fastener tape, and first and second portions coupled via the filled portion.

In some embodiments, the through-hole penetrates through at least one of the reinforcing films.

In some embodiments, the through-hole penetrates through both of the reinforcing films.

In some embodiments, the pair of fastener stringers are arranged adjacent in a left-right direction, the pair of fastener stringers are closed by the frontward movement of the slider, and the embedded portion includes a right-side portion of the reinforcing film provided on the left-side fastener stringer or includes a left-side portion of the reinforcing film provided on the right-side fastener stringer.

In some embodiments, the pair of fastener stringers are arranged adjacent in a left-right direction, the pair of fastener stringers are closed by the frontward movement of the slider, and at least one of the terminal members is configured to extend frontward relative to a front-side contour line of the reinforcing film.

In some embodiments, the terminal portion of the fastener tape is provided with a notch adjacent to the terminal member.

In some embodiments, the pin is a bar-like portion extending along the elongation direction of the fastener tape.

A method of producing a slide fastener according to an aspect of the present disclosure may comprise: attaching reinforcing films to both tape surfaces of at least one fastener tape in a space portion of a fastener chain where the fastener element is partially removed, the fastener chain including a pair of fastener stringers each provided with a fastener element at a bent side-edge portion of a fastener tape; and forming a resin-made terminal member fixed to the fastener tape adjacently to the fastener element in the space portion, the terminal member being a pin or a socket, wherein the terminal member is formed such that each reinforcing film has an embedded portion embedded in the terminal member.

In some embodiments, further included is forming a through-hole that penetrates through at least the fastener tape in the space portion.

In some embodiments, said forming a through-hole that penetrates through at least the fastener tape in the space portion includes forming a through-hole that penetrates through the reinforcing film and the fastener tape in the space portion.

In some embodiments, further included is forming a notch in the space portion.

In some embodiments, said forming a resin-made terminal member fixed to the fastener tape adjacently to the fastener element in the space portion includes arranging first and second molds to be in contact one another at least in the notch.

Advantageous Effects of Invention

According to an aspect of the present disclosure, it would be possible to avoid or mitigate one or more disadvantages due to the employment of the reinforcing portion of the pin or the socket.

BRIEF DESCRIPTION OF DRAWINGS

FIG. 12 is a schematic process view of a slide fastener according to an aspect of the present disclosure, showing that resin-made terminal members are formed through injection-molding each fixed to fastener tape adjacently to fastener element. Terminal members are formed through injection-molding such that both reinforcing films, sandwiching the fastener tape, have an embedded portion that is embedded in the terminal member.

DESCRIPTION OF EMBODIMENTS

Figure 1:
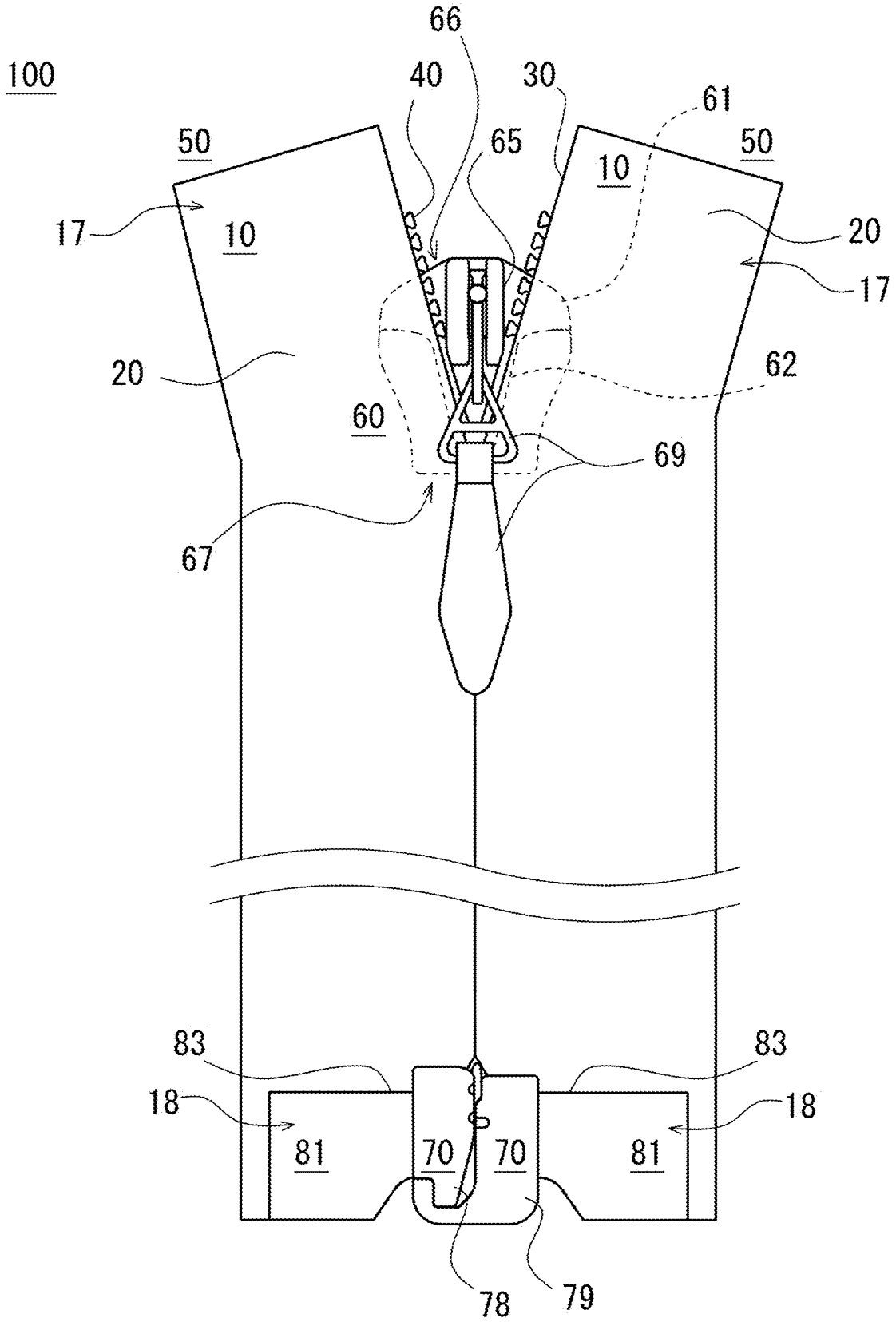
FIG. 1 is a schematic top view of a slide fastener according to an aspect of the present disclosure where left and right fastener elements are partially disengaged by a slider. Terminal members are provided at the terminals of the respective fastener stringers. The terminal member is a pin or a socket.
Figure 2:
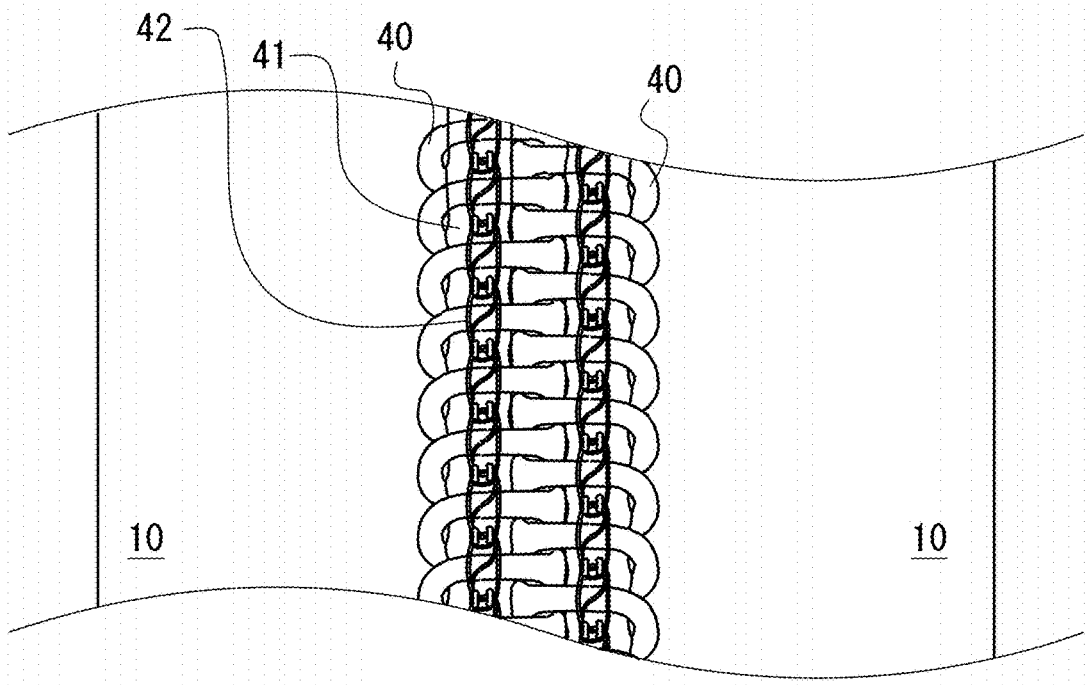
FIG. 2 is a schematic bottom view of a slide fastener according to an aspect of the present disclosure, showing engaged left and right fastener elements provided at bent side-edge portions of fastener tapes.
Figure 3:
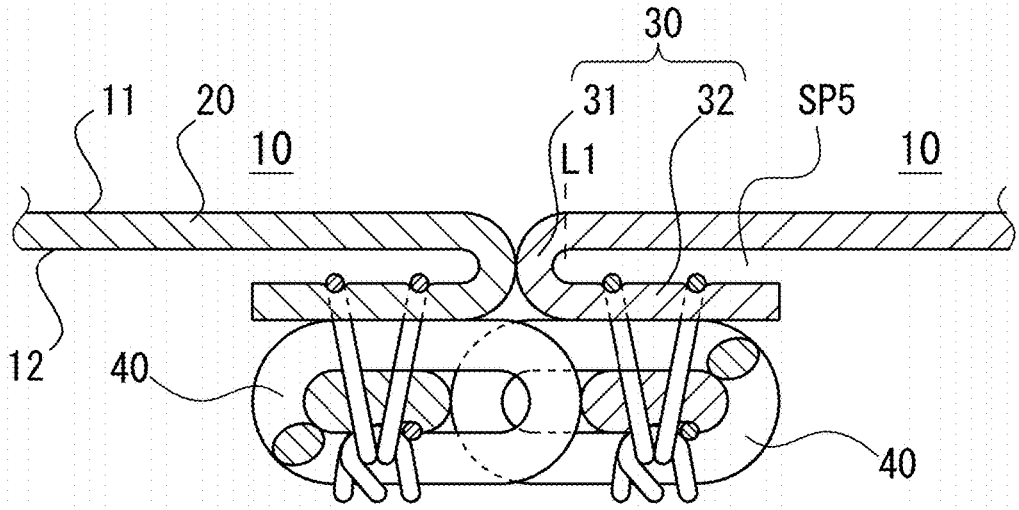
FIG. 3 is a schematic partial cross-sectional view of a slide fastener according to an aspect of the present disclosure, showing engaged left and right fastener elements provided at bent side-edge portions of fastener tapes.
Figure 4:
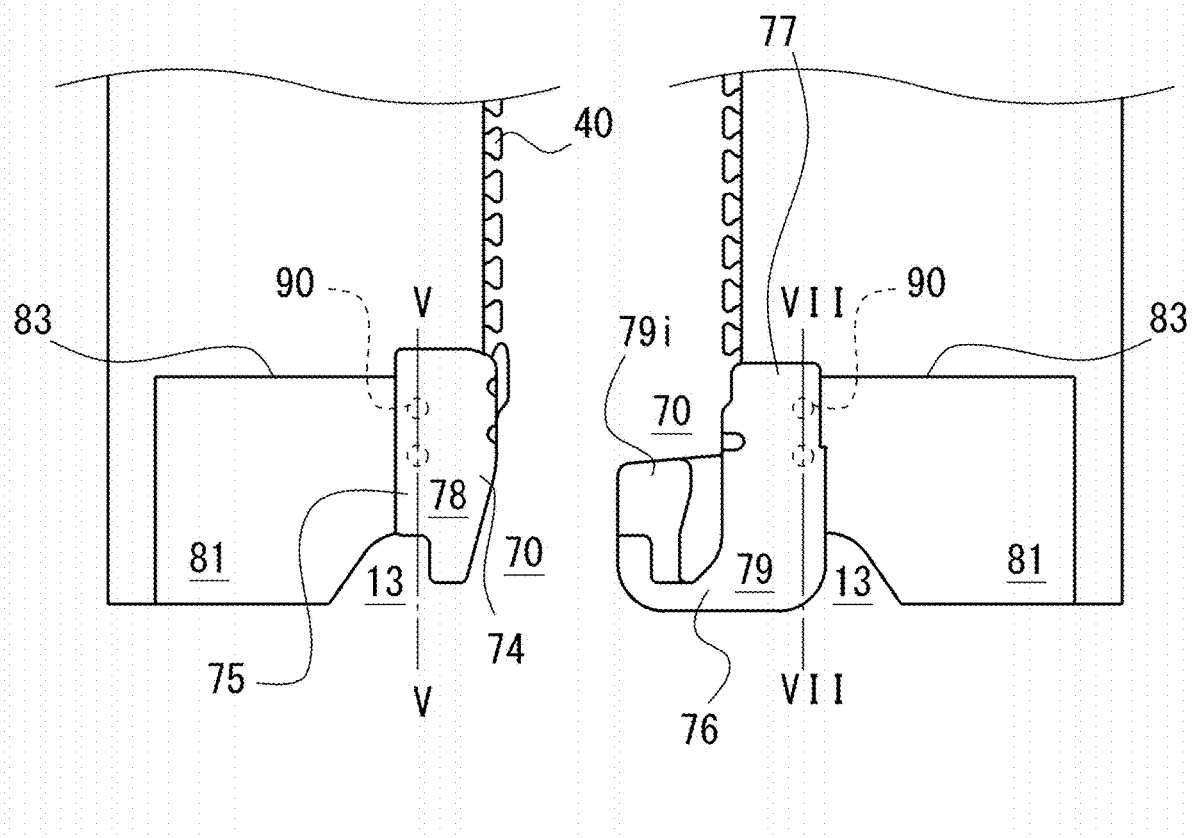
FIG. 4 is a schematic partial top view of a slide fastener according to an aspect of the present disclosure, showing separated left and right fastener stringers. Pin at the left fastener stringer and socket at the right fastener stringer are separated.

Hereinafter, non-limiting exemplary embodiments of the present invention will be described with reference to FIGS. 1 to 17. Disclosed one or more exemplary embodiments and respective features included in the exemplary embodiments are not mutually exclusive. A skilled person would be able to combine respective exemplary embodiments and/or respective features without requiring excess descriptions. Also a skilled person would appreciate synergistic effects of such combinations. Overlapping descriptions among the exemplary embodiments would be basically omitted. Referenced drawings are prepared for the purpose of illustration of invention, and may possibly be simplified for the sake of convenience of illustration.

For the purpose of facilitating reader's understanding, terms indicating directions would be referred to when non-limiting exemplary embodiments of the present invention are described with reference to FIGS. 1-13. Terms indicating directions should not be referred for the purpose of limiting the claimed invention except when it is clearly identified in the claims. In the present specification, left-right direction and front-rear direction would be understood based on the followings. Concretely, in the present specification, a pair of fastener stringers are adjacently arranged in left-right direction, and this pair of fastener stringers are closed based on frontward movement of a slider. Left-right direction and front-rear direction would be clearly understood from this. Front-rear direction is equal to movement direction of the slider. The pair of left and right fastener stringers are opened based on rearward movement of slider. The left-right direction is orthogonal to the front-rear direction and is parallel to tape surface of tape main portion of fastener tape described below. Up-down direction is orthogonal to the front-rear direction and the left-right direction. Font-rear direction, left-right direction, and up-down direction can be redefined in light of the following descriptions.

As shown in FIGS. 1-4, a slide fastener 100 has a pair of fastener stringers 50 each including fastener element 40 provided at a bent side-edge portion 30 of a fastener tape 10; a slider 60 that moves for opening or closing the pair of fastener stringers 50; and a pair of resin-made terminal members 70 fixed to the respective fastener tapes 10 adjacently to the fastener element 40 at the terminal portions 18 of the fastener tapes 10 in the elongation direction of the fastener tape 10. The pair of terminal members 70 comprises a pin 78 and a socket 79 configured to receive the pin 78. The pin 78 is a bar-like portion that extends along the elongation direction of the fastener tape 10.

Hereinafter, the pair of fastener stringers 50 may be referred to as a pair of left and right fastener stringers 50. Accordingly, each fastener stringer 50 may be referred to as left or right fastener stringer. Likewise, each fastener element of each fastener stringer 50 may be referred to as left or right fastener element. Likewise, the pair of terminal members 70 may be referred to as a pair of left and right terminal members 70. Each terminal member 70 may be simply referred to as a pin 78 or socket 79. The left-right direction is a direction understood in light of the pair of fastener stringer 50 to be opened or closed by the slider 60 as described above. Accordingly, the left-right direction stated in the present specification may differ from a perceived direction based on a viewer looking at a slide fastener in the real world.

Illustration of FIG. 1 example allows to understand that, in the slide fastener 100 according to the present exemplary embodiment, the engaged left and right fastener elements 40 existing at the bottom side of the slide fastener 100 is prevented, by the left and right fastener tapes 10, more correctly by the tape main portions 20 described below, from being viewed from the top side of the slide fastener 100. Such slide fastener 100 is referred to as "conceal-type slide fastener" in view of that the fastener elements 40 at the bottom side of the slide fastener 100 are concealed by the fastener tapes 10, more correctly by the tape main portions 20 described below, from the top side of the slide fastener 100. Note that, when the slide fastener 100 is fully closed, a pull tab 69 can be seen. Therefore, opening the slide fastener 100 would be an easy operation either.

Each fastener stringer 50 has a fastener tape 10, and a fastener element 40 provided at a bent side-edge portion 30 of the fastener tape 10. The fastener tape 10 is an elongated flexible member that extends in one direction, i.e. front-rear direction while maintaining the bent side-edge portion 30. The fastener tape 10 extends along the front-rear direction while maintaining a constant cross-sectional shape taken along the left-right direction. Material of the fastener tape 10 may include woven fabric or knitted fabric or mixture thereof. In a case where the fastener tape 10 includes a woven or knitted part of threads, contact area with different material, e.g. resin such as fastener element 40 may be easily ensured. Note that, the thread is made of twisted natural fibers or plant fibers or chemical fibers or other various fibers.

Additionally to the bent side-edge portion 30, the fastener tape 10 has a tape main portion 20 that is a part other than the bent side-edge portion 30. The boundary between the bent side-edge portion 30 and the tape main portion 20 may be a position indicated by a dotted line L1 in FIG. 3, not necessarily limited to this though. The bent side-edge portion 30 and the tape main portion 20 extend along the elongation direction of the fastener tape 10, i.e. the front-rear direction. As would be well understood from FIG. 3, the bent side-edge portion 30 has a bent portion 31 and an attachment portion 32 to which the fastener element 40 is attached. The attachment portion 32 is coupled to the tape main portion 20 via the bent portion 31. In other words, the side-edge portion of the fastener tape 10 is folded back so that the fastener tape 10 has the bent side-edge portion 30 and the tape main portion 20.

The attachment portion 32 is provided underneath the tape main portion 20. An interspace SP5 exists between the tape main portion 20 and the attachment portion 32 which allows movement of below-described top plate 62 of the slider 60 therethrough. When the left and right fastener stringers 50 are closed, the left and right bent portions 31 touch one another or are positioned adjacently with a slight interspace in the left-right direction. Note that, the bent portion 31 is the innermost portion of the fastener tape 10 in the left-right direction. Inward in the left-right direction indicates a direction directed toward a center line of the slide fastener extending along the trajectory of slider, while overpassing the fastener tape.

The fastener tape 10 has a first tape surface 11 and a second tape surface 12. The first tape surface 11 and the second tape surface 12 define a thickness of the fastener tape 10. The first tape surface 11 may be referred to as a tape top surface, and the second tape surface 12 may be referred to as a tape bottom surface. The first and second tape surfaces 11, 12 exist at the tape main portion 20, the bent portion 31, and the attachment portion 32. The second tape surface 12 of the tape main portion 20 and the second tape surface 12 of the attachment portion 32 face one another with an interspace SP5 in the up-down direction. The first tape surface 11 of the tape main portion 20 and the first tape surface 11 of the attachment portion 32 are directed oppositely in the up-down direction.

The fastener tape 10 maintains a bent shape of the side-edge portion, i.e. the bent side-edge portion 30. The fastener tape 10 maintains its folded shape, as wrinkles remain in clothes normally. In some cases, the fastener tape 10 with folded side-edge portion is pressure-processed, alternatively or additionally thermal processed. Accordingly, the shape of the fastener tape 10 with folded side-edge portion is firmly maintained. It is envisioned that the fastener tape 10 with folded side-edge portion is immersed in a resin liquid and then the resin liquid is cured so that the shape of the fastener tape 10 is firmly fixed. Any various methods may be employed so that the fastener tape 10 can be configured to maintain the shape of the folded side-edge portion, i.e. the bent side-edge portion 30.

The fastener element 40 is provided at the attachment portion 32 of the bent side-edge portion 30 of the fastener tape 10. In some embodiments including the illustrated example, the fastener element 40 is a coil-like element configured by spiral winding of monofilament. The fastener element 40 may be attached to the first tape surface 11 of the attachment portion 32 by double chain stitching using sewing threads. In another embodiment, the fastener element 40 may be an array of resin or metal elements arranged along the front-rear direction with constant interspaces.

The slider 60 would be appropriately configured by a skilled person in the art. Various types of sliders for the conceal slide fasteners are known at the time of filling of this application. An exemplary configuration of a slider will be described with reference to the illustrated exemplary slider 60 in FIG. 1 as an example. In some embodiments including the illustrated example, the slider 60 has a base plate 61 and a pair of top plates 62 each connected to the side-edge of the base plate 61 via a wall. A post 65 is provided at the center of the base plate 61 in the left-right direction. Left and right fastener elements 40 are disengaged by the post 65. The fastener elements 40 and the attachment portion 32 would be interposed between the base plate 61 and the top plate 62. Each top plate 62 would be inserted into the interspace SP5 between the tape main portion 20 and the attachment portion 32.

The slider 60 has a pair of left-side and right-side front mouths 66 sandwiching the post 65. The slider 60 has one rear mouth 67. Y-shaped passage for fastener elements 40 is formed between the pair of left-side and right-side front mouths 66 and the rear mouth 67. V-shaped passage for the bent portions 31 is formed between the pair of left-side and right-side front mouths 66 and the rear mouth 67. The slider 60 may be a metal or resin slider.

Each terminal member 70 is fixed to the fastener tape 10 adjacently to the fastener element 40 in the terminal portion of the fastener tape 10 in the elongation direction of the fastener tape 10. In some embodiments including the illustrated example, the left-side terminal member 70 is a pin 78, and the right-side terminal member 70 is a socket 79. In another example, a right-side terminal member 70 is a pin 78, and a left-side terminal member 70 is a socket 79.

In some embodiments including the illustrated example, as would be understood from FIGS. 5 to 8, the pin 78 and the socket 79 have grooves G7 in spatial communication with the interspace SP5. The top plate 62 of the slider 60 can move inside the grooves G7 likewise the interspace SP5. The groove G7 of the pin 78 penetrates through the pin 78 in the front-rear direction. The groove G7 of the socket 79 does not penetrate through the socket 79 in the front-rear direction.

In the present disclosure, reinforcing films 81,82 are attached onto the tape surfaces 11, 12 of at least one fastener tape 10 at its terminal portion 18. Furthermore, each reinforcing film 81,82 has an embedded portion 88 that is embedded in the terminal member 70. The fastener tape 10 is protected by the reinforcing film 81,82. The strength of the fastener tape 10 will also be improved in a place where the reinforcing film 81,82 is provided (in other words, its flexibility will be lowered), allowing the improved operability of the terminal member 70. As the reinforcing film 81,82 has an embedded portion 88 embedded in the terminal member 70, the reinforcing film 81,82 is suppressed from being easily peeled off the fastener tape 10. In some embodiments, the respective reinforcing films 81,82 are infiltrated into the organization of the fastener tape 10, and the respective reinforcing films 81, 82 are coupled one another in the fastener tape 10, not necessarily limited to this though.

As stated at the beginning, in a case of patent literature 2, the reinforcing portions 34, 35 may be partially damaged, the flexibility of fastener tape may be lowered, and attachment of a slide fastener to an article such as clothing or the like may be disturbed in greater or lesser degree. According to the present disclosure, at least one or more of these disadvantages may be avoided or mitigated.

Figure 5:
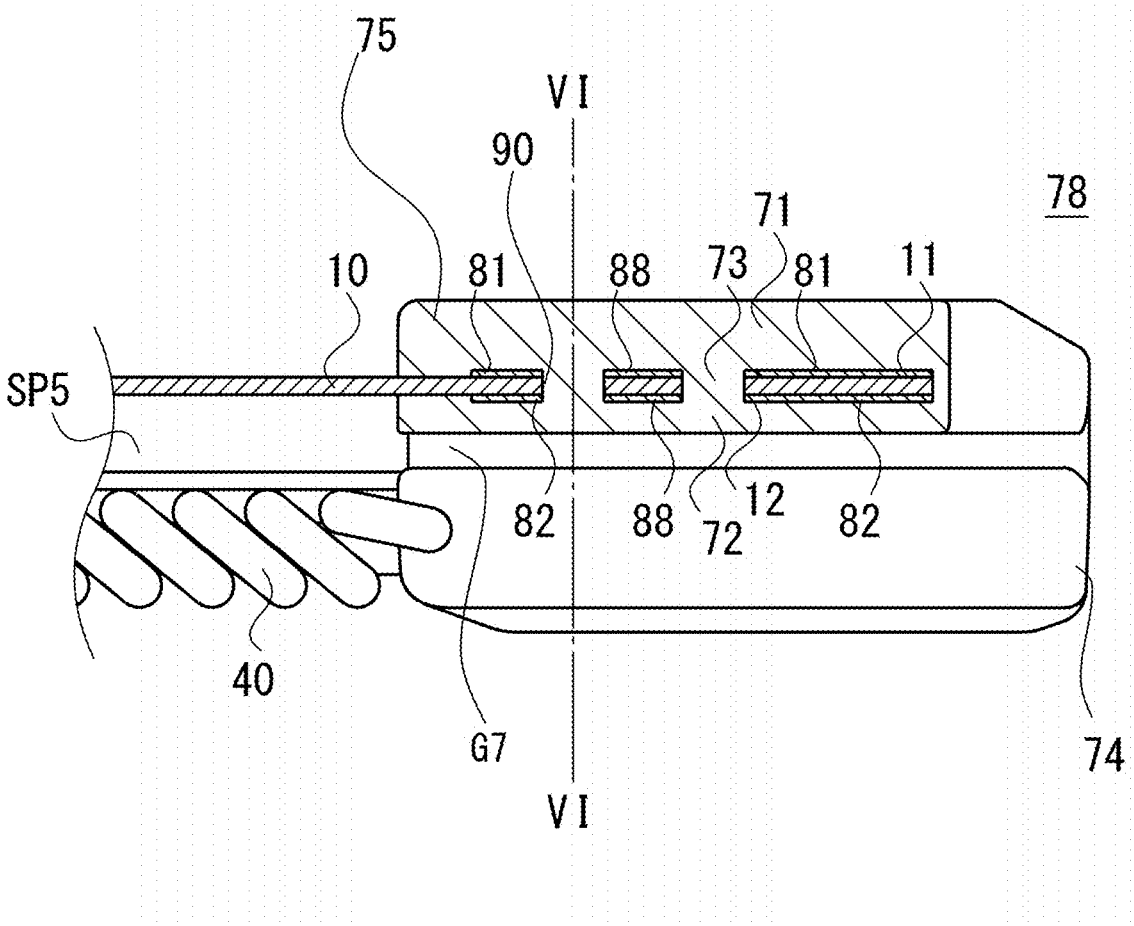
FIG. 5 is a schematic cross-sectional view taken along a line V-V in FIG. 4.
Figure 6:
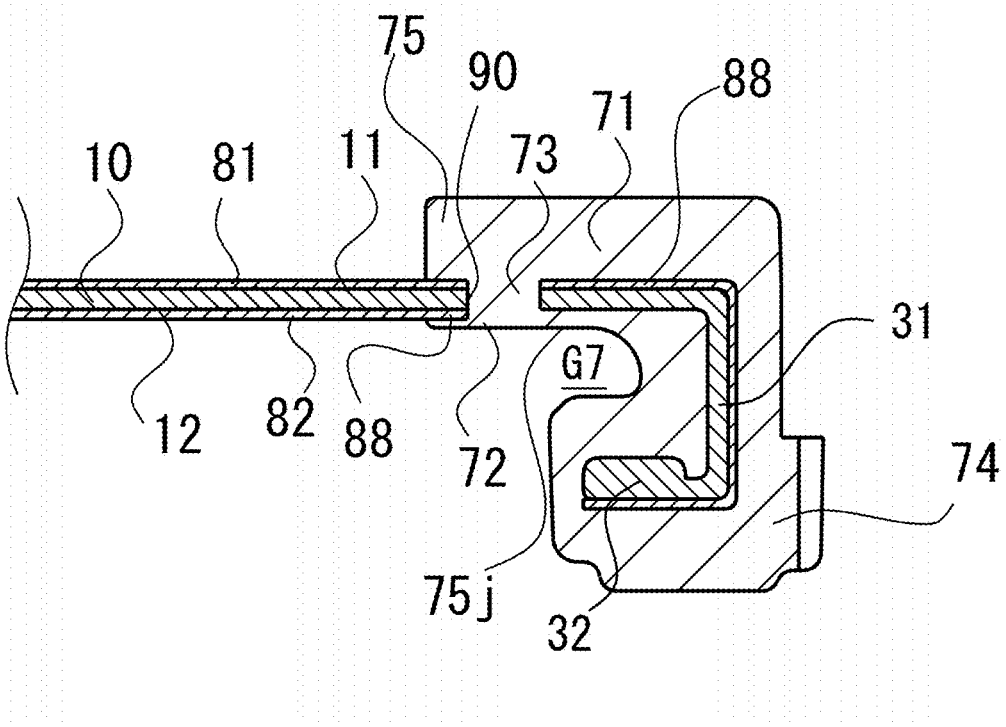
FIG. 6 is a schematic cross-sectional view taken along a line VI-VI in FIG. 5.
Figure 7:
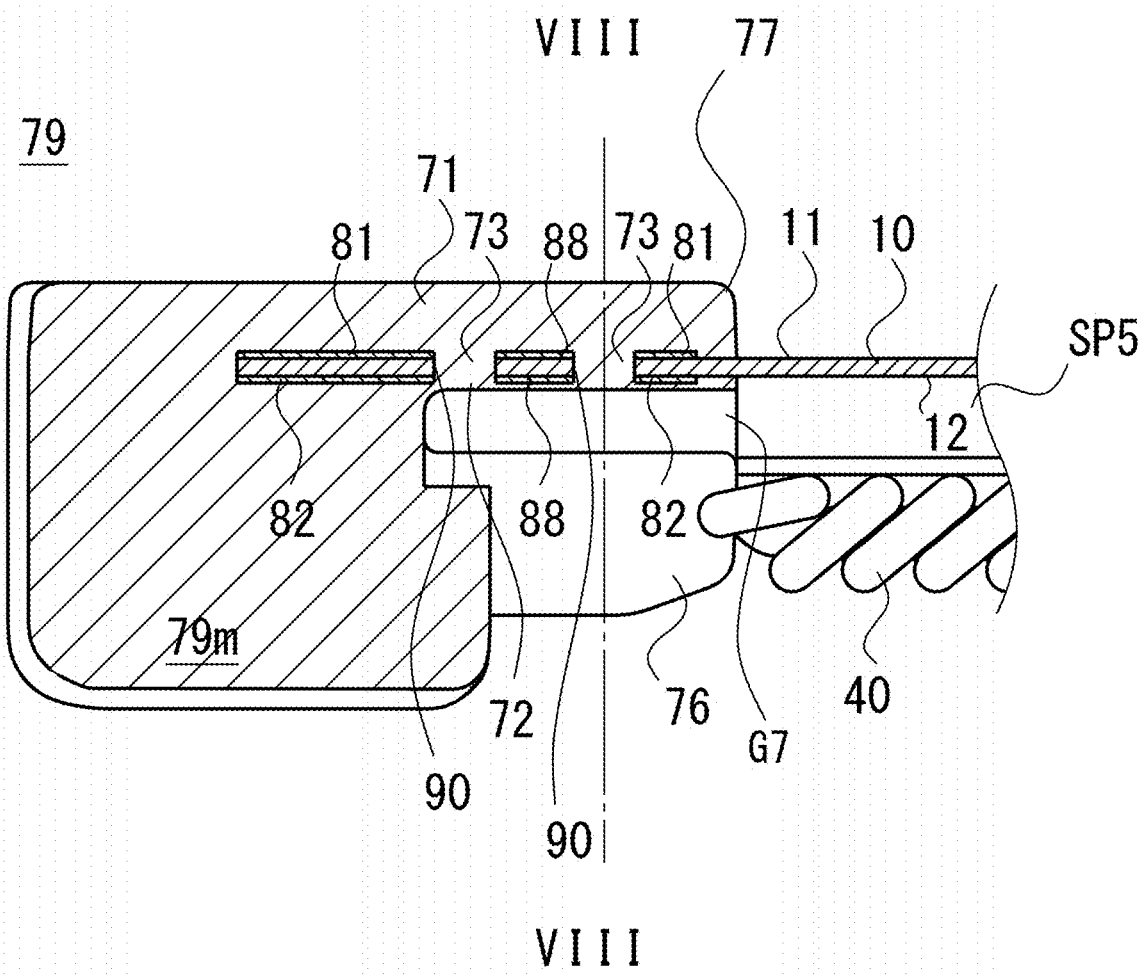
FIG. 7 is a schematic cross-sectional view taken along a line VII-VII in FIG. 4.
Figure 8:
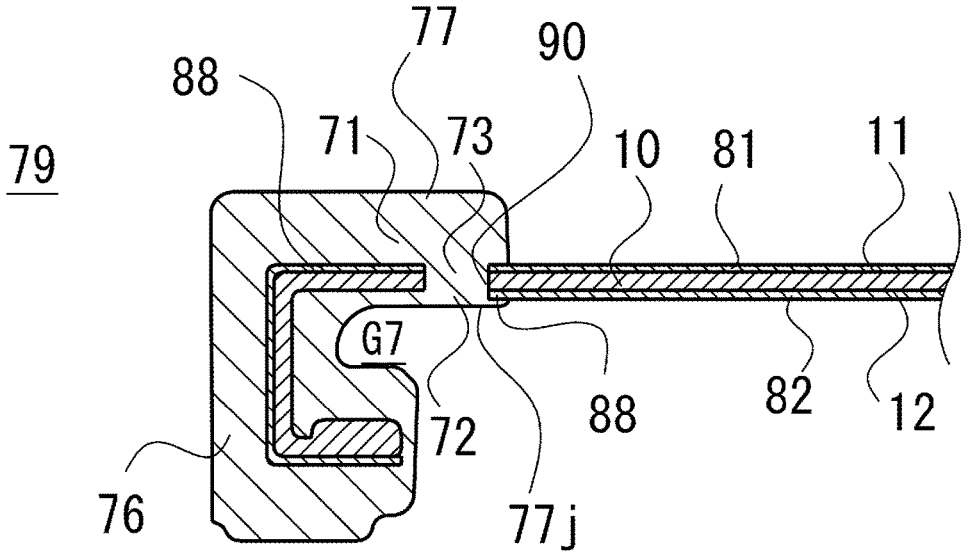
FIG. 8 is a schematic cross-sectional view taken along a line VIII-VIII in FIG. 7.

In some embodiments including the illustrated example, as would be understood from FIGS. 5 and 6, each reinforcing film 81,82 has an embedded portion 88 embedded in the pin 78. As would be understood from FIGS. 7 and 8, each reinforcing film 81, 82 has an embedded portion 88 embedded in the socket 79

The pair of reinforcing films 81,82 may be referred to as first and second reinforcing films 81, 82. The first reinforcing film 81 may be referred to as a top reinforcing film. The second reinforcing film 82 may be referred to as a bottom reinforcing film.

In some embodiments including the illustrated example, the first reinforcing film 81 is attached not only to the tape main portion 20 but also to the bent side-edge portion 30, i.e. the bent portion 31 and the attachment portion 32, not necessarily limited to this though. In contrast, the second reinforcing film 82 is attached only to the tape main portion 20. Various exemplary modifications are envisioned in terms of attachment area of the first and second reinforcing films 81, 82 onto the fastener tape 10, and thus it should be construed that all various exemplary modifications are included in the claimed scope except clearly excluded therein. In one exemplary modification, attachment of the first reinforcing film 81 is limited to the tape main portion 20 likewise the second reinforcing film 82. In another exemplary modification, the second reinforcing film 82 is attached not only onto the tape main portion 20 but also onto the bent side-edge portion 30, e.g. at least one or both of the bent portion 31 and the attachment portion 32.

Each reinforcing film 81,82 may be made of any suitable material. Each reinforcing film 81,82 may be a resin film that will be softened by heating, for example. The resin film may be referred to as a laminating film, which is commercially available. For example, the resin film may be a film made of resin such as polyester, polyethylene, polyamide, and polyurethane. In some embodiments including the illustrated example, in order to enhance cohesion between the fastener tape 10 and the reinforcing film, a pressure is applied to the reinforcing film such that a lattice-like protrusion is formed on a surface of the reinforcing film.

In some embodiments including the illustrated example, each terminal member 70 includes a bar 74,76 and a flange 75,77, and a groove G7 is provided between the bar 74,76 and the flange 75,77. The bar 74,76 is fixed to the bent side-edge portion 30. The flange 75,77 is fixed to the tape main portion 20 of the fastener tape 10 which is a part other than the bent side-edge portion 30. Mechanical strength of the terminal member 70 itself is improved by the flange 75,77. Furthermore, this contributes to an increased fixing strength of the terminal member 70 to the fastener tape 10.

In some embodiments including the illustrated example, as would be understood from FIGS. 5 and 6, the pin 78 includes a bar 74 fixed to the bent side-edge portion 30, and a flange 75 fixed to the tape main portion 20. A groove G7 is provided between the bar 74 and the flange 75. As would be understood from FIGS. 7 and 8, the socket 79 includes a bar 76 fixed to the bent side-edge portion 30, and a flange 77 fixed to the tape main portion 20. A groove G7 is provided between the bar 76 and the flange 77.

Plate portion of slider 60, e.g. the top plate 62 described above in some embodiments including the illustrated example, is inserted between the bar 74,76 and the flange 75,77. The top plate 62 of the slider 60 is prevented or suppressed from touching the reinforcing film 82 so as to damage the reinforcing film 82. The wall surface 75*j*,77*j* of the flange 75,77 defining the grooves G7 is positioned downward relative to the bottom surface of the reinforcing film 82.

In some embodiments including the illustrated example, the socket 79 has a socket body 79*m* coupled to the bar 76 and the flange 77. The socket body 79*m* is configured such that the pin 78 can be fitted therewith. The socket body 79*m* has an insertion portion 79*i* that is inserted into the groove G7 of the pin 78 (See FIG. 4).

In some embodiments including the illustrated example, at least one terminal member 70 includes a filled portion 73 that is filled in a through-hole 90 provided in the tape main portion 20 of the fastener tape, and first and second portions 71, 72 coupled via the filled portion 73. This increases the unity of the terminal member 70 and the fastener tape 10.

In some embodiments including the illustrated example, the flange 75,77 includes a filled portion 73 that is filled in a through-hole 90 provided in the tape main portion 20 of the fastener tape, and first and second portions 71, 72 coupled via the filled portion 73. This increases the unity of the terminal member 70 and the fastener tape 10.

In some embodiments including the illustrated example, as would be understood from FIGS. 5 and 6, the flange 75 of the pin 78 includes a filled portion 73 that is filled in a through-hole 90 provided in the tape main portion 20 of the fastener tape, and first and second portions 71, 72 coupled via the filled portion 73. As would be understood from FIGS. 7 and 8, the flange 77 of the socket 79 includes a filled portion 73 that is filled in a through-hole 90 provided in the tape main portion 20 of the fastener tape, and first and second portions 71, 72 coupled via the filled portion 73.

In some embodiments including the illustrated example, two through-holes 90 are provided for one terminal member 70. As a result, one terminal member 70 has two filled portions 73. However, exemplary variations are envisioned where one through-hole 90 is provided or where two or more, e.g. three through-holes 90 are provided. In some embodiments including the illustrated example, the through-holes 90 are arrange on the same line, but an exemplary variation is envisioned where the through-holes 90 are arranged in zigzag. A variation is envisioned where the through-hole 90 is arranged at the bent side-edge portion 30 additionally, not only at the tape main portion 20. Various combinations of these variations are also envisioned.

In some embodiments including the illustrated example, at least one reinforcing film 81,82 has an end embedded in the flange 75,77. In some embodiments including the illustrated example, as would be understood from FIGS. 6 and 8, at each one of the pin 78 and the socket 79, the second reinforcing film 82 has an end embedded in the flange 75,77. Accordingly, the end of the second reinforcing film 82 is prevented or suppressed from directly touching the slider 60.

In some embodiments including the illustrated example, the through-hole 90 penetrates through at least one of the reinforcing films 81, 82 of the pair. In some embodiments including the illustrated example, the through-hole 90 penetrates through both of the reinforcing films 81, 82 of the pair. A case in envisioned where the through-hole 90 penetrates through the fastener tape 10 only. These exemplary variations will be described with reference to FIGS. 14-17.

As described above, each reinforcing film 81, 82 has an embedded portion 88 embedded in the terminal member 70, thus avoiding or suppressing the reinforcing film 81, 82 from being peeled off the fastener tape 10. Regarding this feature, in some embodiments including the illustrated example, the embedded portion 88 includes a right-side portion of the reinforcing film 81, 82 provided on the left-side fastener stringer 50, or includes a left-side portion of the reinforcing film 81, 82 provided on the right-side fastener stringer 50. That is, the embedded portion 88 includes an inward portion of each reinforcing film 81, 82 in the left-right direction. This effectively suppresses the reinforcing film 81, 82 from being peeled off the fastener tape 10.

In some embodiments including the illustrated example, the embedded portion 88 includes a front portion of the reinforcing film 81, 82 on the left-side fastener stringer 50 or includes a front portion of the reinforcing film 81, 82 on the right-side fastener stringer 50. That is, the embedded portion 88 includes a front portion of each reinforcing film 81, 82. This effectively suppresses the reinforcing film 81, 82 from being peeled off the fastener tape 10.

In some embodiments including the illustrated example, at least one terminal member 70 is configured to extend frontward relative to/than the front-side contour line 83 of the reinforcing film 81, 82. This effectively suppresses the reinforcing film 81, 82 from being peeled off the fastener tape 10.

In some embodiments including the illustrated example, a notch 13 is provided adjacent to the terminal member 70 at the terminal portion 18 of the fastener tape 10. The notch 13 is partially occupied by the terminal member 70.

When the pin 78 and the socket 79 are to be coupled, the pin 78 is inserted into the slider 60 via the left-side front mouth 66 of the slider 60 positioned adjacently frontward of the socket 79. The pin 78 moves inside of the slider 60, and is fitted with the socket body of the socket 79. The slider 60 is pulled frontward, and the left and right fastener elements 40 start to be engaged.

When the pin 78 and the socket 79 are to be decoupled, the slider 60 moves rearward, and its top plate 62 enters from the interspace SP5 into the grooves G7 of the terminal members 70. The slider 60 collides with the socket body 79*m* of the socket 79 and stops there. The left and right fastener elements 40 are perfectly disengaged. The pin 78 is moved frontward so that the pin 78 is removed off the socket 79 and the slider 60.

Various machines may be used by a skilled person to produce the above-described slide fasteners 100 through various methods. Presenting an example of method of producing a slide fastener 100 may be redundant for a proficient skilled person. However, this may be beneficial for an inexperienced skilled person. In view of this, a non-limiting example of production method of slide fastener 100 would be presented hereinafter. Of course, slide fasteners 100 according to the present disclosure are expected to be produced by using various machines and methods. A method of producing a slide fastener 100 according to the present disclosure should not be limited to a particular method described below. A skilled person in the art would envision various other methods in light of a particular method described below.

Figure 9:
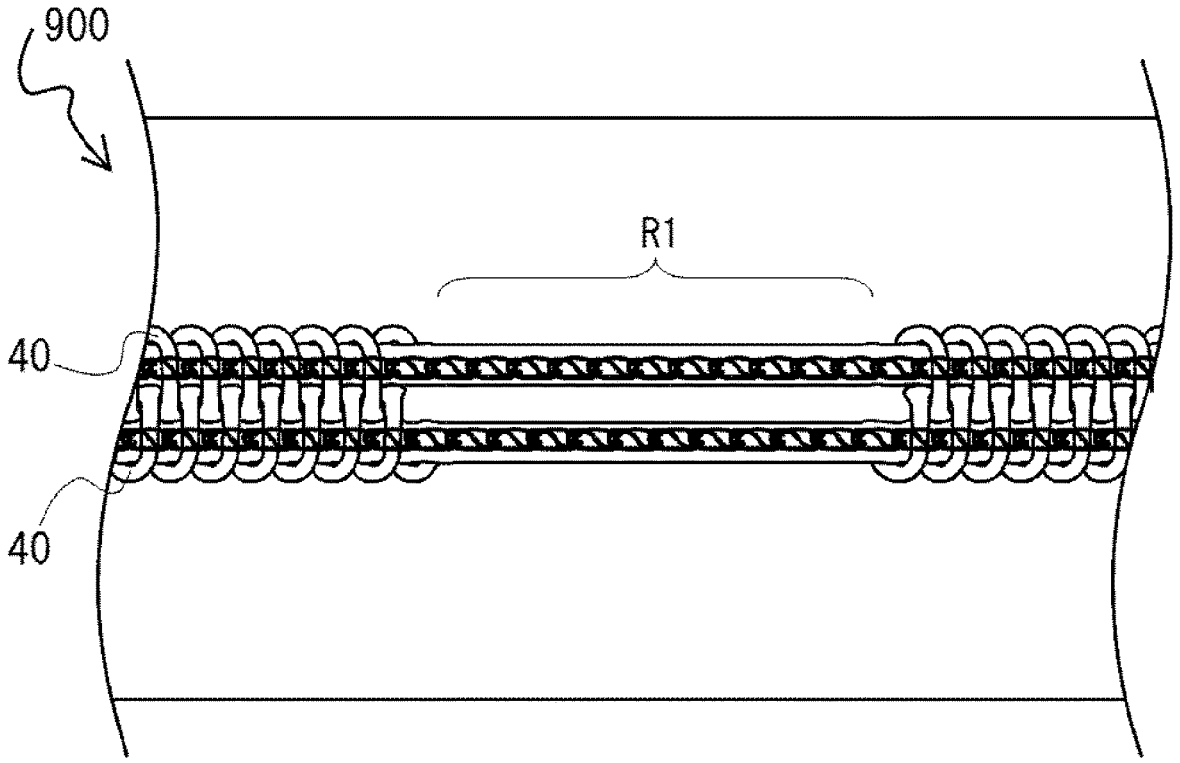
FIG. 9 is a schematic process view of a slide fastener according to an aspect of the present disclosure, showing a space portion of a fastener chain where fastener elements of the respective fastener stringers have been removed and do not exist there.
Figure 10:
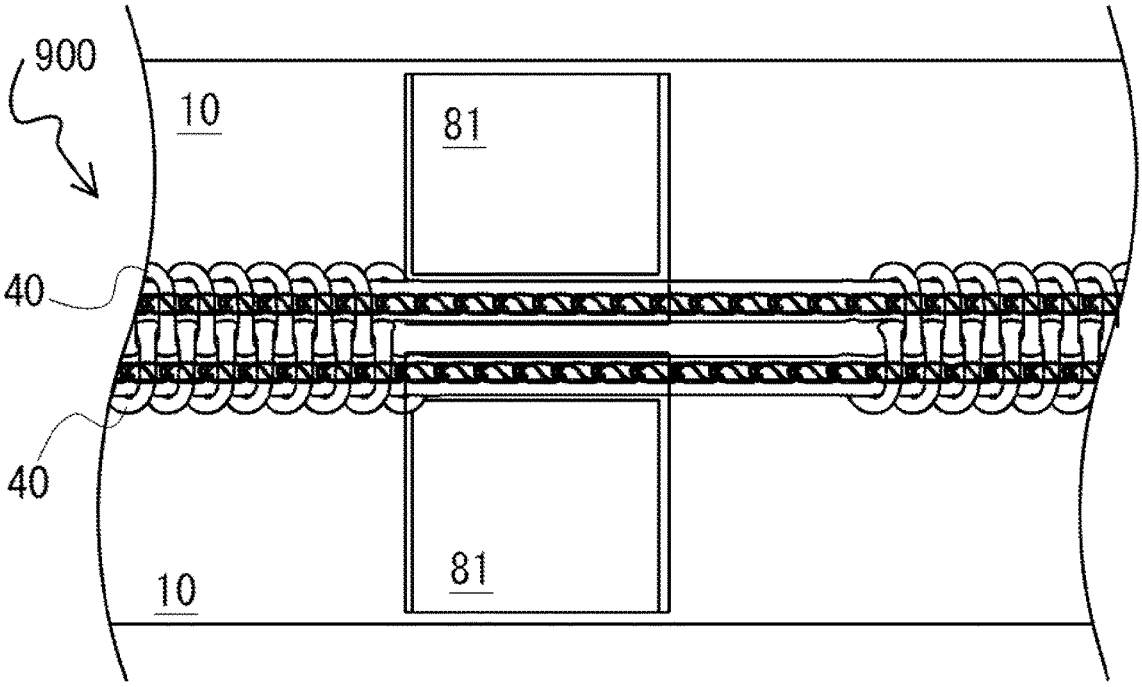
FIG. 10 is a schematic process view of a slide fastener according to an aspect of the present disclosure where reinforcing films are attached to respective top surfaces of fastener tape.
Figure 11:
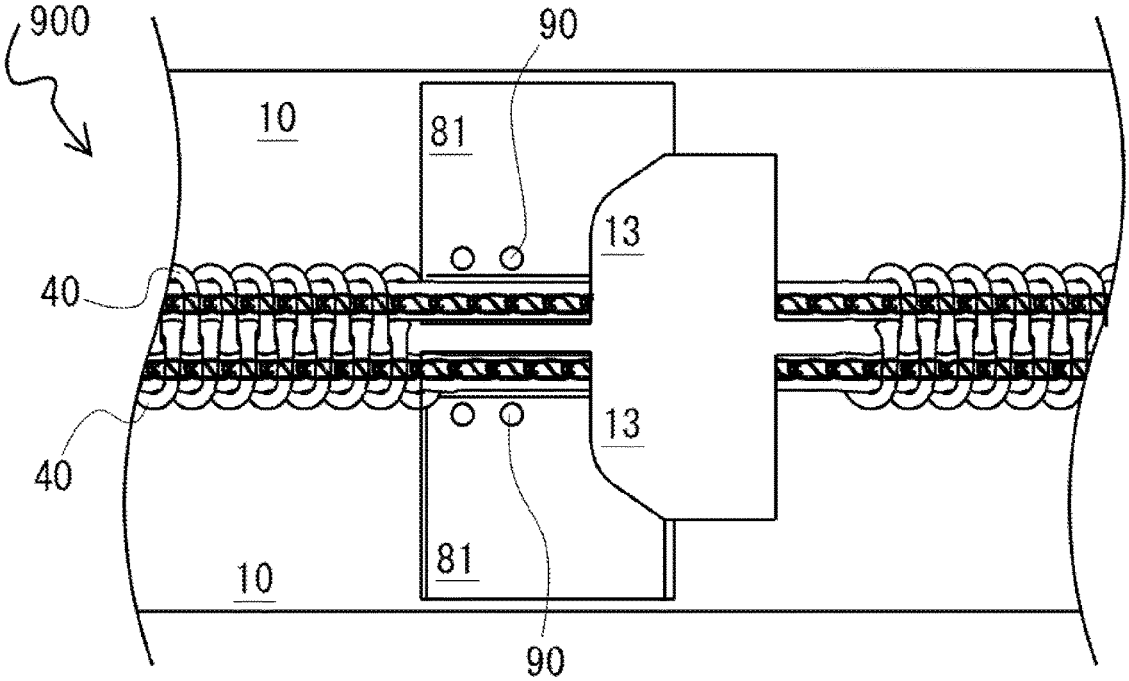
FIG. 11 is a schematic process view of a slide fastener according to an aspect of the present disclosure, showing that through-hole and notch are formed.
Figure 12:
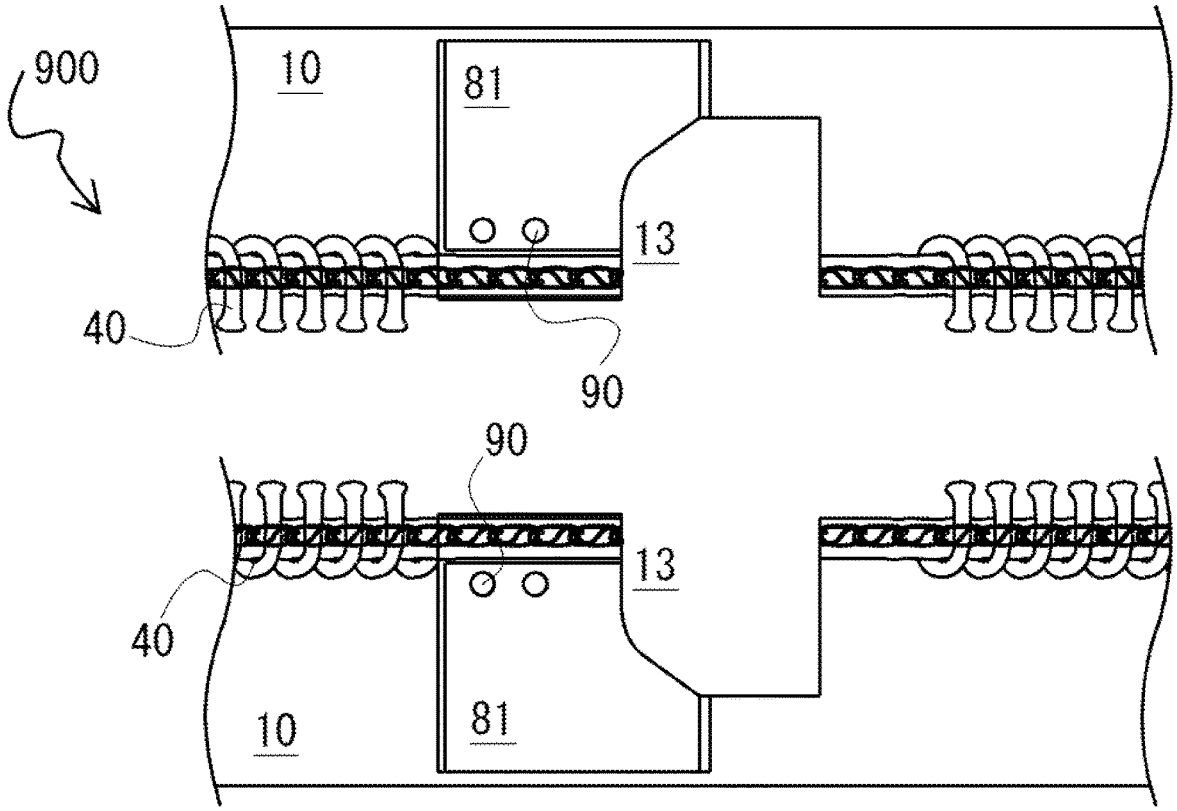
FIG. 12 is a schematic process view of a slide fastener according to an aspect of the present disclosure, showing that left and right fastener stringers are separated.
Figure 13:
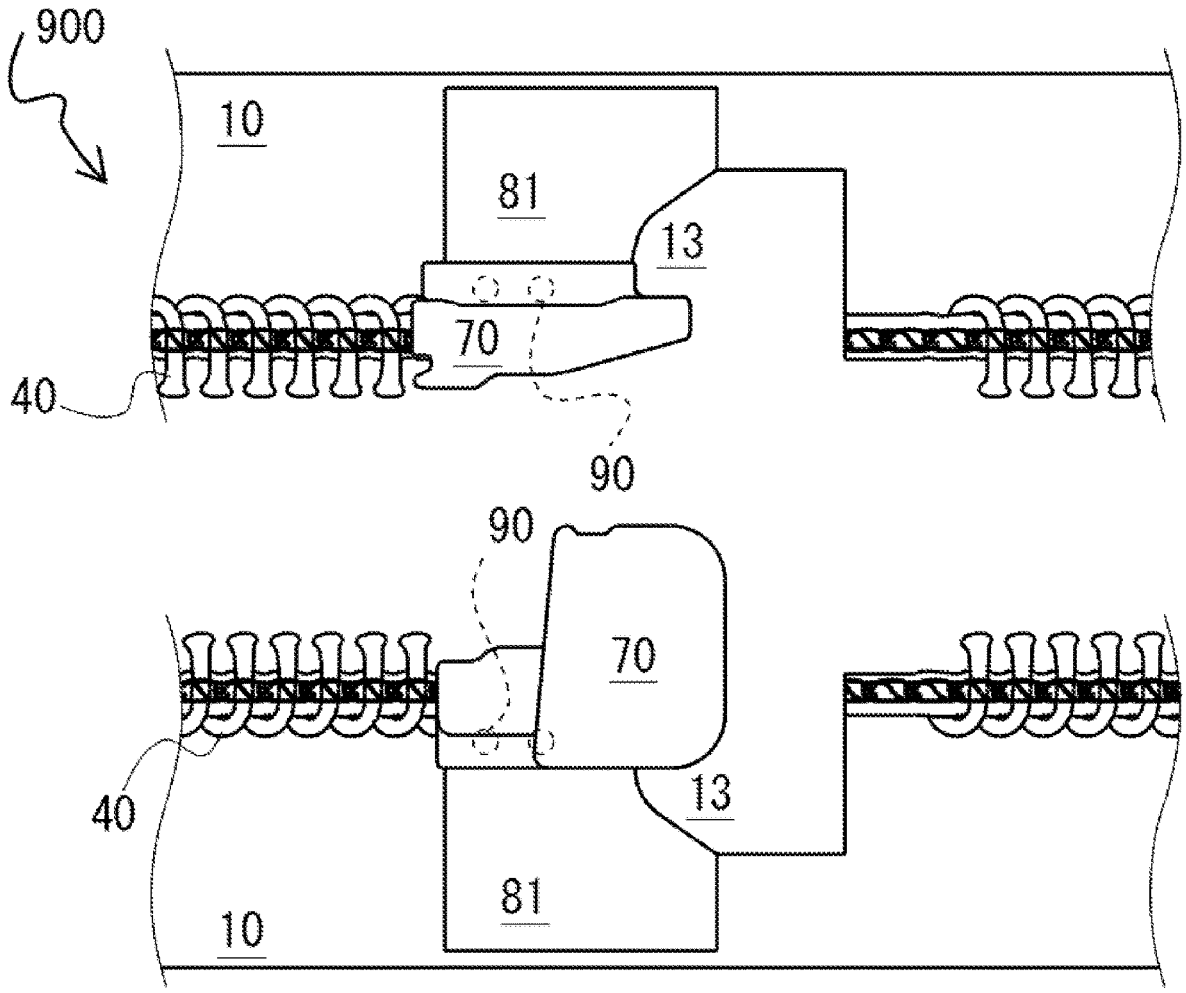

In some embodiments including the illustrated example, a method of producing a slide fastener 100 includes steps of processing a fastener chain 900 as shown in FIGS. 9-13. FIG. 9 shows a fastener chain 900 provided with a space portion R1 where fastener elements 40 are partially removed. FIG. 10 shows a step of attaching reinforcing films 81, 82 onto both tape surfaces of the fastener tapes 10 in the space portion R1 of the fastener chain 900. FIG. 11 shows a step of forming a through-hole 90 that penetrating through at least the fastener tape 10 in the space portion R1 and a step of forming a notch 13 in the space portion R1. FIG. 12 shows a step of opening the fastener chain 900. FIG. 13 shows a step of forming a resin-made terminal member 70 that is fixed to the fastener tape 10 adjacently to the fastener element 40 in the space portion R1. The terminal member 70 may be a pin 78 or a socket 79. In some embodiments including the illustrated example, the terminal member 70 is formed such that each reinforcing film 81, 82 has an embedded portion 88 embedded in the terminal member 70.

The fastener tape 10 is interposed between the reinforcing films 81, 82 so that the fastener tape 10 is protected. Moreover, the flexibility of the fastener tape 10 is lowered at the location where the reinforcing film 81, 82 is provided, enhancing the operability of the terminal member 70. As the reinforcing film 81, 82 has the embedded portion 88 embedded in the terminal member 70, the reinforcing film 81, 82 is suppressed from easily peeled off the fastener tape 10.

In some embodiments including the illustrated example, the step of forming a through-hole 90 that penetrates through at least the fastener tape 10 in the space portion R1 includes a step of forming a through-hole 90 that penetrates through the reinforcing film 81, 82 and the fastener tape 10 in the space portion R1.

In some embodiments including the illustrated example, in the step of forming the resin-made terminal member 70 that is fixed to the fastener tape 10 adjacently to the fastener elements 40, first and second molds are used for injection molding of resin while sandwiching the fastener tape 10. At least in the notch 13, the first and second mold are arranged in contact one another.

FIG. 13 is followed by cutting the fastener chain 900 at the space portion R1. As such, a number of slide fasteners 100 can be taken out from the fastener chain 900. In some cases, the fastener element 40 of the fastener chain 900 is inserted through the slider 60 before the step of FIG. 9, not necessarily limited to this though.

Figure 14:
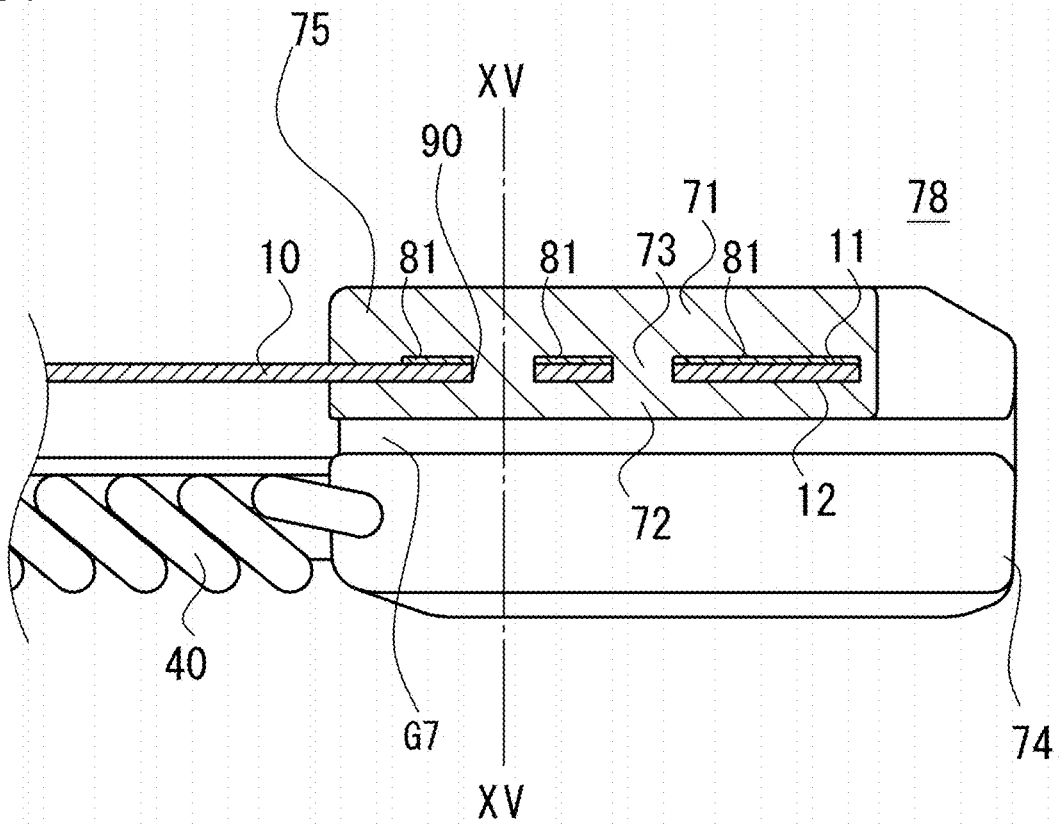
FIG. 14 is a schematic view of an example where through-hole penetrates through first reinforcing film and tape main portion.
Figure 15:
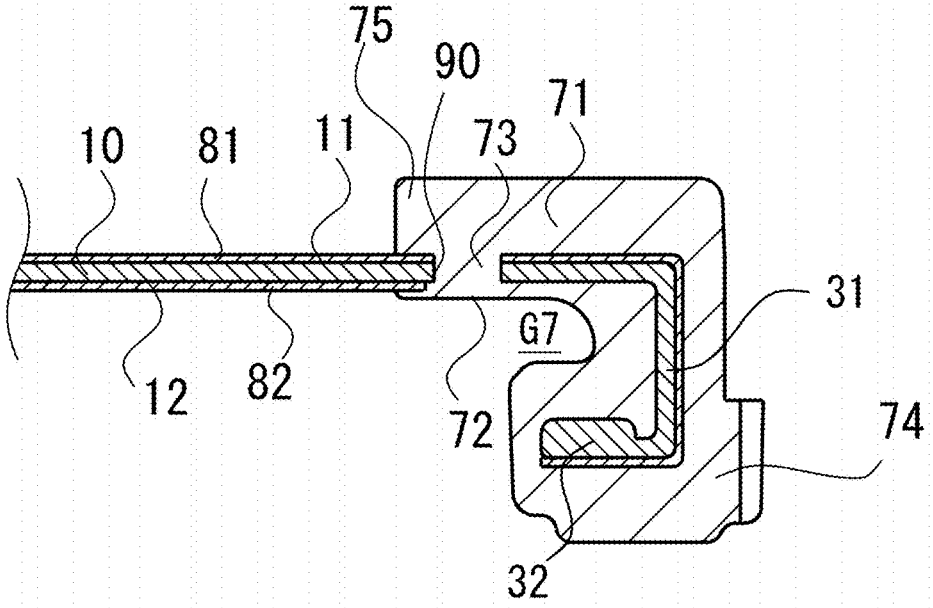
FIG. 15 is a schematic view of an example where through-hole penetrates through first reinforcing film and tape main portion.
Figure 16:
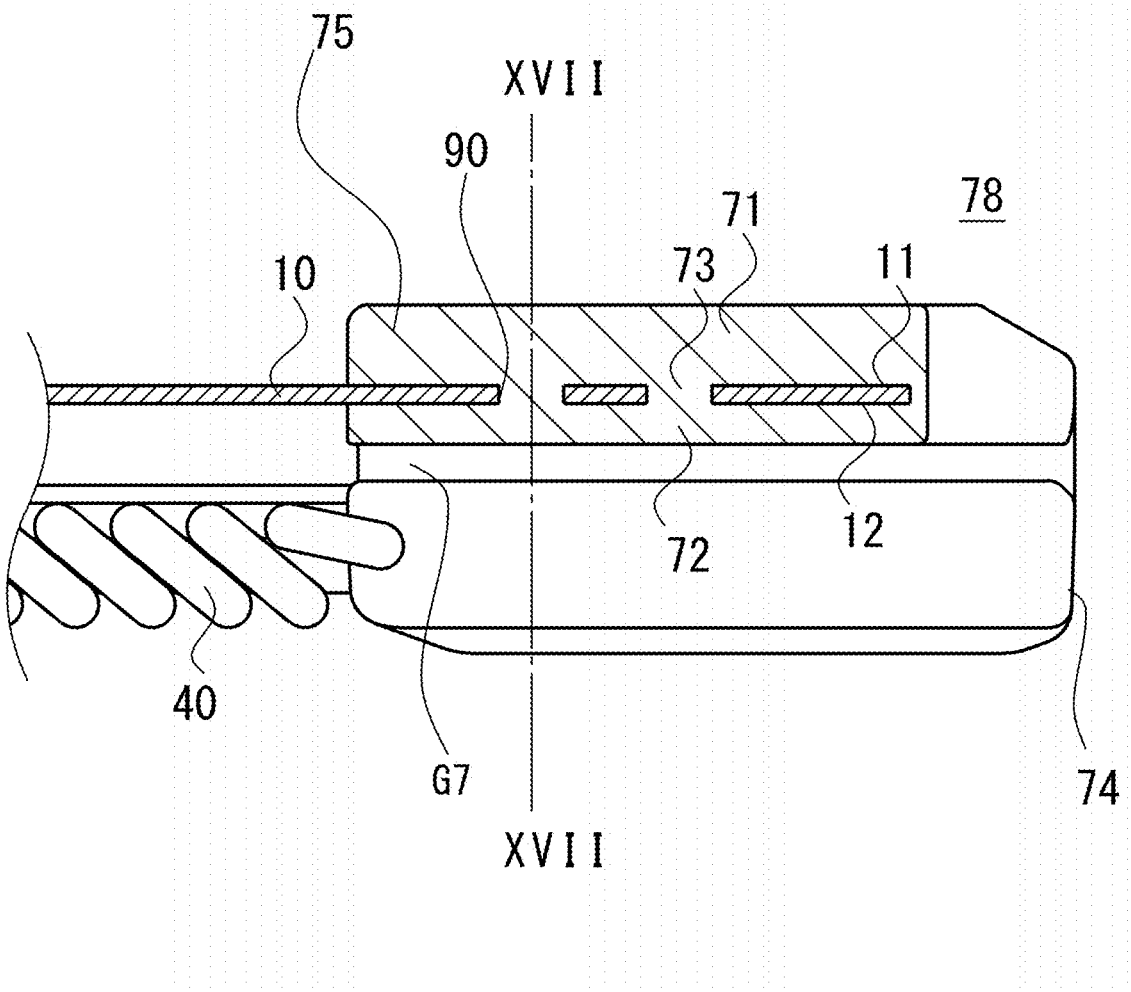
FIG. 16 is a schematic view of an example where through-hole penetrates through tape main portion only.
Figure 17:
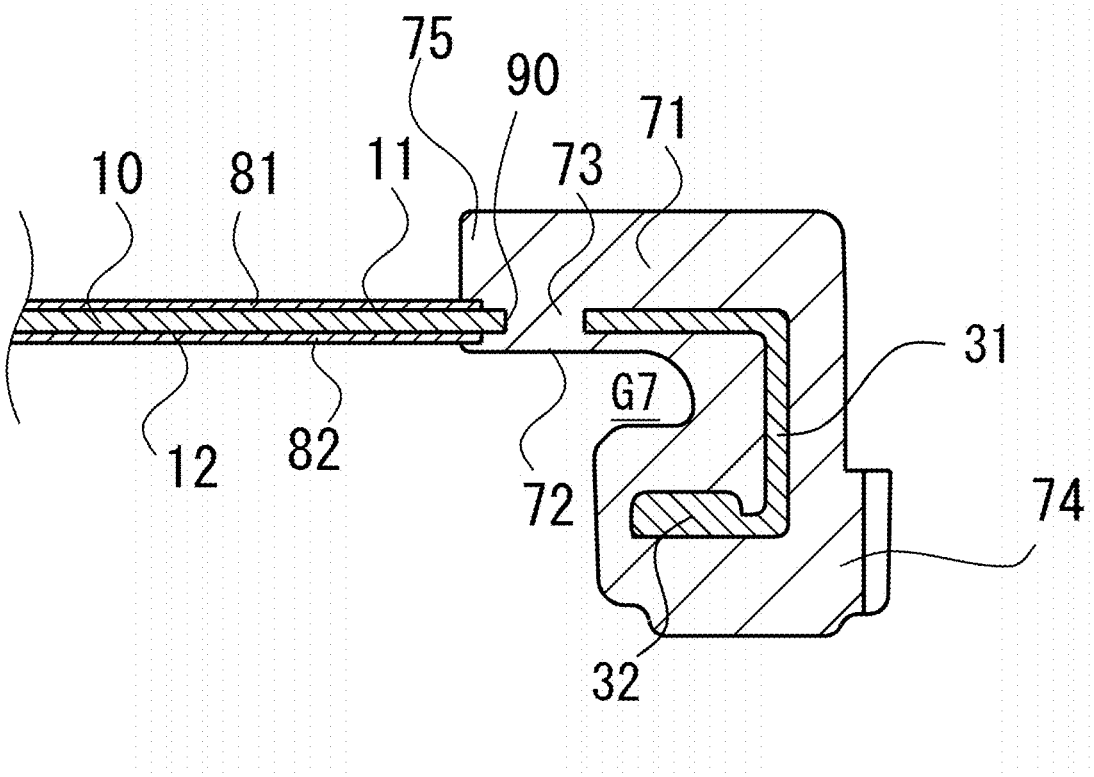
FIG. 17 is a schematic view of an example where through-hole penetrates through tape main portion only.

FIGS. 14 and 15 show an example where the through-hole 90 penetrates through the first reinforcing film 81 and the tape main portion 20. FIGS. 16 and 17 show an example where the through-hole 90 penetrates through the tape main portion 20 only. Even in these exemplary variations, the same technical effect as that of the above-stated features would be obtained. Features identified by "in the present disclosure" or "in some embodiments including the illustrated example" or equivalent thereof would be understood as a feature effective not only to one embodiment, e.g. the illustrated example but also effective to other various embodiments, e.g. various non-illustrated examples.

Based on the above teaching, a skilled person in the art would be able to add various modifications to the respective embodiments. Reference numerals in Claims are just for reference and should not be referred for the purpose of narrowly construing the scope of claims.

REFERENCE SIGNS LIST

10 Fastener tape
11 Tape surface
12 Tape surface

18 Terminal portion
30 Bent side-edge portion
40 Fastener element
50 Fastener stringer
60 Slider
70 Terminal member
78 Pin
79 Socket
81 Reinforcing film
82 Reinforcing film
88 Embedded portion
100 Slide fastener

The invention claimed is:

1. A slide fastener comprising:

a pair of fastener stringers, each of the pair of fastener stringers including a fastener tape and a fastener element, the fastener tape including a tape main portion and a bent side-edge portion, the bent side-edge portion including a bent portion and an attachment portion, an interspace being formed between the tape main portion and the attachment portion, and the fastener element being secured to the attachment portion;

a slider that moves for opening or closing the pair of fastener stringers;

a pair of resin-made terminal members comprising a pin and a socket configured to receive the pin, each of the pin and the socket being fixed to the fastener tape adjacently to the fastener element in a terminal portion of the fastener tape in an elongation direction of the fastener tape, and each of the pin and the socket comprising a bar fixed to the bent side-edge portion, a flange fixed to the tape main portion, and a groove formed between the bar and the flange and in spatial communication with the interspace; and reinforcing films attached to both tape surfaces of at least one of the fastener tapes in the terminal portion, each of the reinforcing films having an embedded portion embedded in the flange of at least one of the terminal members.

2. The slide fastener of claim 1, wherein one of the reinforcing films has an end that is embedded in the flange.

3. The slide fastener of claim 1, wherein at least one of the terminal members includes a filled portion that is filled in a through-hole provided in the tape main portion of the fastener tape, and first and second portions coupled via the filled portion.

4. The slide fastener of claim 3, wherein the through-hole penetrates through at least one of the reinforcing films.

5. The slide fastener of claim 3, wherein the through-hole penetrates through both of the reinforcing films.

6. The slide fastener of claim 3, wherein the second portion is arranged to define the groove and is thinner than the first portion.

7. The slide fastener of claim 1, in which the pair of fastener stringers are arranged adjacent in a left-right direction and the pair of fastener stringers are closed by a frontward movement of the slider, wherein the embedded portion includes a right-side portion of the reinforcing film provided on a left-side fastener stringer or includes a left-side portion of the reinforcing film provided on a right-side fastener stringer.

8. The slide fastener of claim 1, in which the pair of fastener stringers are arranged adjacent in a left-right direction and the pair of fastener stringers are closed by a frontward movement of the slider, wherein at least one of the terminal members is configured to extend frontward relative to a front-side contour line of the reinforcing film.

9. The slide fastener of claim 1, wherein the terminal portion of the fastener tape is provided with a notch adjacent to the terminal member.

10. The slide fastener of claim 1, wherein the pin is a bar-like portion extending along the elongation direction of the fastener tape.

11. The slide fastener of claim 1, wherein one of the reinforcing films is selectively formed onto a portion of the tape main portion and the other one of the reinforcing films is formed onto a portion of the tape main portion and the bent side-edge portion.

12. The slide fastener of claim 1, wherein the respective flanges of the pin and the socket comprise first and second portions coupled by at least one filled portion filling a through-hole, the through-hole penetrating both the reinforcing films.

13. The slide fastener of claim 12, wherein the first and second portions are coupled by a plurality of filled portions.

14. The slide fastener of claim 1, wherein the terminal portion of the fastener tape is provided with a notch adjacent to the respective terminal member, the flange being arranged inwardly in a left-right direction relative to the notch, the left and right direction being orthogonal to a front-rear direction along which the slider moves.

15. A method of producing a slide fastener comprising:

attaching reinforcing films to both tape surfaces of at least one fastener tape in a space portion of a fastener chain where a fastener element is partially removed, the fastener chain including a pair of fastener stringers each provided with the fastener element at a bent side-edge portion of a fastener tape;

forming a through-hole that penetrates through at least the fastener tape in the space portion; and forming a resin-made terminal member fixed to the fastener tape adjacently to the fastener element in the space portion, the terminal member being a pin or a socket, wherein the terminal member is formed such that each reinforcing film has an embedded portion embedded in the terminal member.

16. The method of producing the slide fastener of claim 15, wherein forming a through-hole that penetrates through at least the fastener tape in the space portion includes forming the through-hole that penetrates through the reinforcing film and the fastener tape in the space portion.

17. The method of producing the slide fastener of claim 15, further comprising forming a notch in the space portion.

18. The method of producing the slide fastener of claim 17, wherein forming the resin-made terminal member fixed to the fastener tape adjacently to the fastener element in the space portion includes arranging first and second molds to be in contact with one another at least in the notch.

* * * * *